US005146897A

United States Patent [19]

Hattori et al.

[11] Patent Number: 5,146,897

[45] Date of Patent: Sep. 15, 1992

[54] INTAKE MANIFOLD OF INTAKE SYSTEM FOR MULTI-CYLINDER INTERNAL COMBUSTION ENGINE

[75] Inventors: Toshihiko Hattori; Mitsuo Hitomi, both of Hiroshima; Toshimitsu Tanaka, Otaki; Naoyuki Yamagata, Hiroshima, all of Japan

[73] Assignee: Mazda Motor Corporation, Hiroshima, Japan

[21] Appl. No.: 759,433

[22] Filed: Sep. 13, 1991

[30] Foreign Application Priority Data

Sep. 20, 1990 [JP] Japan ..... 2-248622

[51] Int. Cl.[5] ..... F02M 55/00; F02M 31/00; F02B 3/00

[52] U.S. Cl. ..... 123/470; 123/52 M; 123/305; 123/545

[58] Field of Search ..... 123/52 M, 470, 472, 123/301, 305, 570, 545, 432

[56] References Cited

U.S. PATENT DOCUMENTS

| | | | |
|---|---|---|---|
| 2,995,123 | 8/1961 | Goschel | 123/470 |
| 3,943,904 | 3/1976 | Byrne | 123/472 |
| 4,149,496 | 4/1979 | Palma | 123/470 |
| 4,378,761 | 4/1983 | Kawamura | 123/470 |
| 4,434,772 | 3/1984 | Hartel et al. | 123/545 |
| 4,475,525 | 10/1984 | Fukae | 123/570 |
| 4,576,131 | 3/1986 | Sugiyama | 123/432 |
| 4,589,381 | 5/1986 | Takayama | 123/470 |
| 4,599,977 | 7/1986 | Materazzi | 123/470 |
| 4,671,234 | 6/1987 | Tegtmeier | 123/432 |
| 4,702,202 | 10/1987 | Hensel et al. | 123/52 M |
| 4,751,905 | 6/1988 | Bonfiglioli et al. | 123/472 |
| 4,768,487 | 9/1988 | Yamamoto et al. | 123/470 |
| 4,817,569 | 4/1989 | Takano et al. | 123/470 |
| 4,852,526 | 8/1989 | Brown | 123/470 |
| 4,909,222 | 3/1990 | Takano et al. | 123/52 M |
| 4,924,834 | 5/1990 | Bonfiglioli et al. | 123/470 |
| 4,938,191 | 7/1990 | Oldani et al. | 123/432 |
| 4,955,347 | 9/1990 | Toyoda | 123/470 |
| 4,982,716 | 1/1991 | Takeda et al. | 123/470 |
| 5,009,200 | 4/1991 | Van Basshuysen et al. | 123/52 M |
| 5,038,725 | 8/1991 | Okazaki et al. | 123/52 M |

FOREIGN PATENT DOCUMENTS

| | | | |
|---|---|---|---|
| 3345345 | 6/1985 | Fed. Rep. of Germany | 123/470 |

*Primary Examiner*—E. Rollins Cross
*Assistant Examiner*—Thomas N. Moulis
*Attorney, Agent, or Firm*—Fleit, Jacobson, Cohn, Price, Holman & Stern

[57] ABSTRACT

An intake manifold for a multi cylinder internal combustion engine has a common upstream passage and individual downstream passages, leading individually to cylinders of the engine, respectively. These individual downstream passages are connected between a downstream end of the common upstream passage and the cylinders. Upstream end portions of the individual downstream passages are symmetrically located around a fuel injector, disposed downstream relative to the common upstream passage, and are joined together. At a center of the symmetrically joined upstream end portions of the individual downstream passages, fuel passages are provided to open independently into the upstream end portions so as to introduce fuel from the fuel injector into the individual downstream passages.

12 Claims, 6 Drawing Sheets

INTAKE MANIFOLD OF INTAKE SYSTEM FOR MULTI-CYLINDER INTERNAL COMBUSTION ENGINE

The present invention relates to an intake system having a manifold for a multi-cylinder internal combustion engine for supplying a fuel mixture into cylinders of the engine.

BACKGROUND OF THE INVENTION

1. Field of the Invention

Intake systems for multi-cylinder internal combustion engines conventionally have an intake manifold which comprises individual intake passage pipes, each leading to respective cylinders and connecting, via a common intake passage pipe, a carburetor and the respective cylinders. Arranging and joining upstream end portions of the individual intake pipes in a regular polygonal formation makes it easy to deliver a fuel mixture from the single carburetor substantially equally into the respective cylinders and contributes to making the intake manifold compact in overall size. It also contributes to reducing vibrations and noises of the multi-cylinder internal combustion engine. Such an intake system is known from, for instance, Japanese Unexamined Utility Model Publication No. 57-101367.

2. Description of Related Art

Intake systems of this kind, for use with the fuel injection type of multi-cylinder internal combustion engines, have a fuel injector (i.e., a downstream fuel injector) after a throttle valve in a downstream portion of each individual intake passage pipe and one or two fuel injectors (i.e., upstream fuel injectors) in a downstream portion of the common intake passage pipe adjacent to upstream ends of the individual intake passage pipes. If the upstream fuel injector is installed in the downstream portion of the common intake passage pipe adjacent to the upstream ends of the individual intake passage pipes, which are symmetrically joined together at their upstream end portions, it is hard to make the intake manifold compact in overall size, and a uniform distribution of fuel mixture into the cylinders is difficult to achieve.

SUMMARY OF THE INVENTION

It is, accordingly, a primary object of the present invention to provide an intake manifold of an intake system for supplying a fuel mixture into a multi cylinder internal combustion engine with a fuel injector located at an upstream end of a plurality of individual intake passages which have upstream end portions joined together.

It is another object of the present invention to provide an intake manifold of an intake system for supplying a fuel mixture into a multi cylinder internal combustion engine which makes it possible to compactly construct the intake system.

It is still another object of the present invention to provide an intake manifold of an intake system for supplying a fuel mixture into a multi cylinder internal combustion engine which can enhance the gasification and atomization of fuel and provide an improved uniformity of fuel distribution to the cylinders.

The above objects of the present invention are accomplished by providing a particularly constructed intake manifold of an intake system for supplying a fuel mixture into a multi cylinder internal combustion engine.

The intake manifold comprises an upstream intake passage means for forming a common upstream passage portion of the intake manifold, common to all of the cylinders of the multi cylinder internal combustion engine, and a downstream intake passage means for forming individual downstream passage portions of the intake manifold, leading individually to the cylinders which are connected between a downstream end of the upstream intake passage means and the cylinders, respectively. Upstream end portions of the individual downstream passage portions are symmetrically located around a fuel injection means, disposed downstream of the upstream intake passage means, and are joined together. The downstream intake passage means is provided with a fuel passage means, opening into the upstream end portion of each individual intake passage portion, for introducing fuel from the fuel injection means into the individual intake passage portions.

Locating the fuel injection means at a center of the upstream end portions of the individual downstream passage portions, symmetrically joined together, allows the upstream end portions of the individual downstream passage portions to be arranged close to one another. This contributes to making the intake system compact in size and enhances the uniformity of fuel distribution to the cylinders as well as the gasification and atomization of fuel.

BRIEF DESCRIPTION OF THE DRAWINGS

The above and other objects and features of the present invention will be apparent to those skilled in the art from the following description of various embodiments thereof when considered in conjunction with the accompanying drawings, wherein similar reference numerals have been used to designate the same or similar elements throughout the drawings, and in which.

DETAILED DESCRIPTION OF THE PREFERRED EMBODIMENTS

Figure 1:
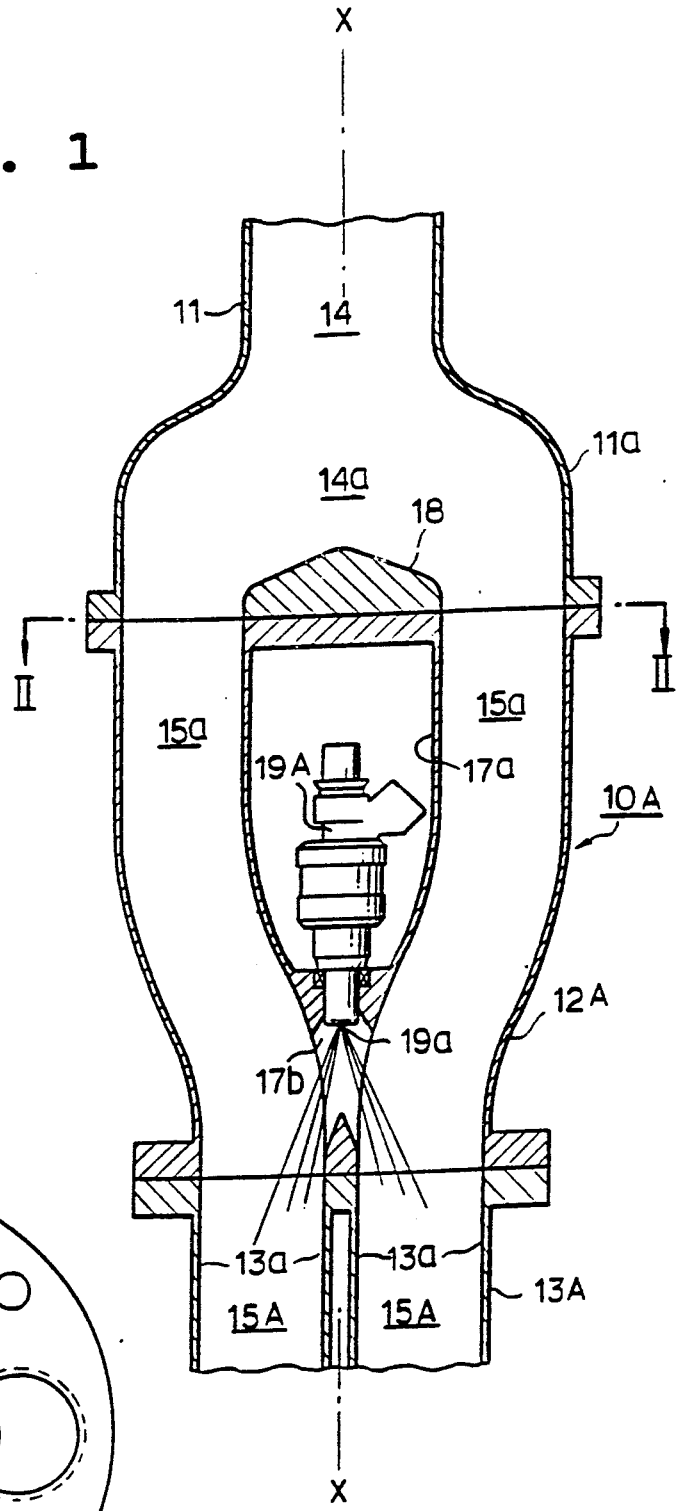
FIG. 1 is a vertical sectional view showing a part of an intake manifold of an intake system for a four-cylinder internal combustion engine in accordance with a preferred embodiment of the present invention.
Figure 2:
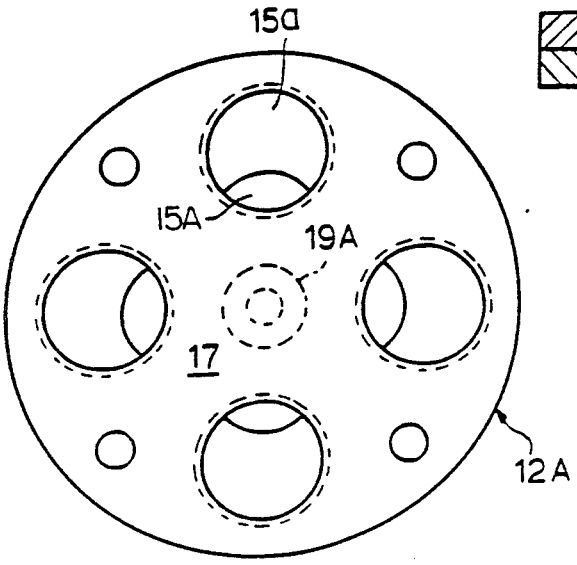
FIG. 2 is a cross sectional view along line II—II of FIG. 1.
Figure 3:
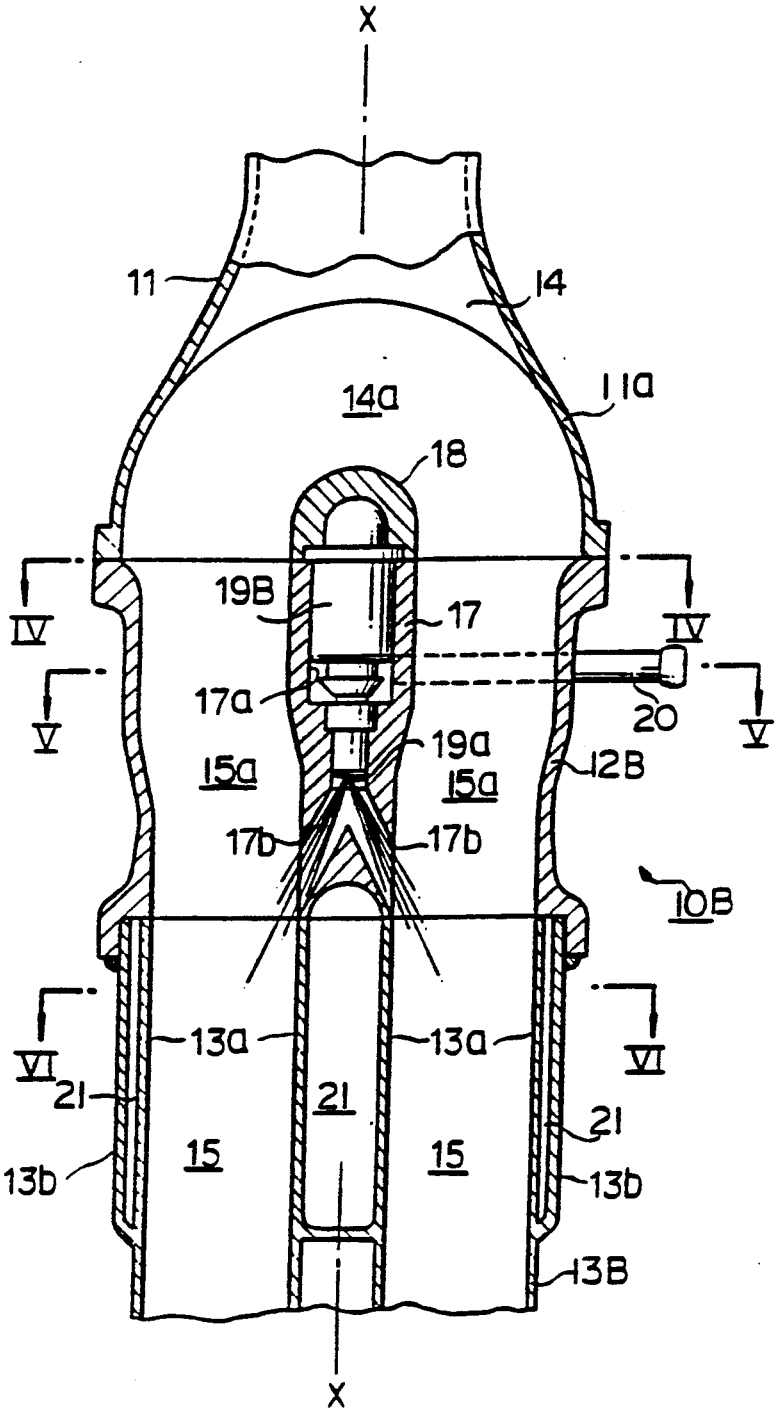
FIG. 3 is a vertical sectional view showing a part of an intake manifold of an intake system for a four-cylinder internal combustion engine in accordance with another preferred embodiment of the present invention.
Figure 4:
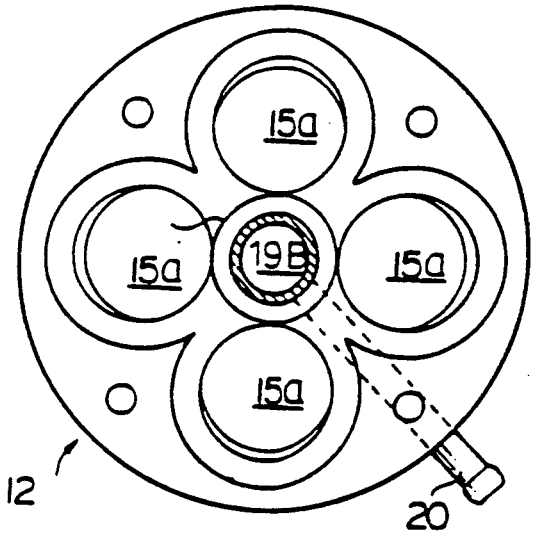
FIG. 4 is a cross sectional view along line IV—IV of FIG. 3.
Figure 5:
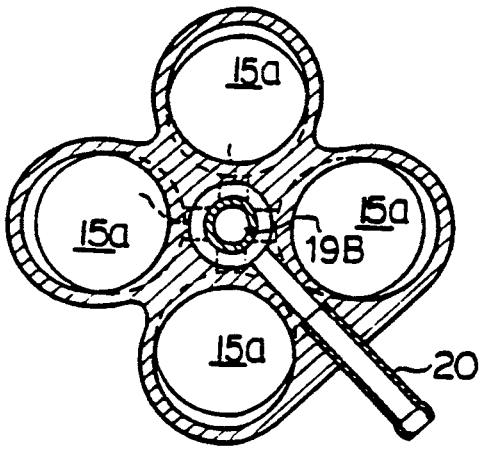
FIG. 5 is a cross sectional view along line V—V of FIG. 3.
Figure 6:
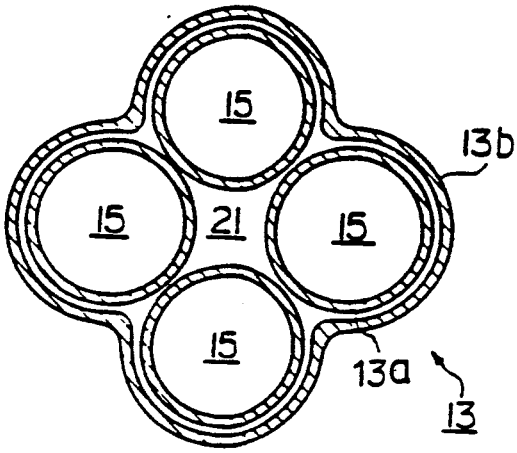
FIG. 6 is a cross sectional view along line VI—VI of FIG. 3.

Referring to the drawings in detail and, in particular, to FIGS. 1 and 2, an intake manifold 1OA for use with a multi cylinder internal combustion engine in accordance with a preferred embodiment of the present invention is shown. The intake manifold comprises, in order from the upstream end remote from the engine, an upstream intake pipe 11 forming an upstream intake passage 14, a connecting intake pipe 12A and a downstream intake pipe 13A. The upstream intake pipe 11 is formed with an enlarged end portion 11*a* so as to form an enlarged passage portion 14*a* at the downstream end of the upstream intake passage 14. The connecting intake pipe 12A, made as an integral part, is formed with four intermediate intake passages 15*a* arranged symmetrically with respect to a longitudinal axis X of the intake manifold 10A. The downstream intake pipe 13A is formed with four downstream intake passages 15A individually in communication with intake ports of the cylinders of the engine at their downstream ends. Upstream end portions of these intake passages are defined by four individual downstream intake pipes 13*a*, joined together, and are arranged symmetrically with respect to a longitudinal axis X of the intake manifold 10A.

The connecting intake pipe 12A and the downstream intake pipe 13A are connected or coupled to each other in flange-to-flange connection so as to align the four individual intermediate intake passages 15*a* with the four individual downstream intake passages 15A respectively. The enlarged end portion 11*a* of the upstream intake pipe 11 is joined or coupled to the connecting intake pipe 12A by a flange-to-flange connection so as to integrate the individual intermediate intake passages 15*a* into the enlarged passage portion 14*a* of the upstream intake pipe 11A.

In a solid portion 17 of the connecting intake pipe 12A, remaining among the individual intermediate intake passages 15*a*, there is formed an axially extending bore 17*a* for receiving therein a fuel injector 19A having an injection nozzle or outlet 19*a*. The solid portion 17 of the connecting intake pipe 12A is further formed with a gallery of four injection bores 17*b*, each of which is independent from the others and extends radially downward from the bottom of the injector receiving bore 17*a* so as to open into the individual intermediate intake passages 15*a*. The fuel injector 19A injects fuel into the individual downstream intake passages 15A through the injection bores 17*b*, respectively. An open end of the injector receiving bore 17*a* of the solid portion 17 is closed by a cap or plug 18.

Referring to FIGS. 3 to 6, an intake manifold 10B for use with a multi cylinder internal combustion engine in accordance with another preferred embodiment of the present invention is shown, comprising, in order from an upstream end, an upstream intake pipe 11 forming an upstream intake passage 14, a connecting intake pipe 12B and a downstream intake pipe 13B. The upstream intake pipe 11 is formed with an enlarged end portion 11*a* so as to form an enlarged passage portion 14*a* at the downstream end of the upstream intake passage 14. The connecting intake pipe 12B, made as an integral part, is formed with four intermediate intake passages 15*a* arranged symmetrically with respect to a longitudinal axis X of the intake manifold 1OB. The downstream intake pipe 13B comprises four downstream intake passages 15, leading individually to the cylinders of the engine, respectively, which are defined by four individual downstream intake pipes 13*a* joined at their upstream end portions and are arranged symmetrically with respect to the longitudinal axis X of the intake manifold 1OB.

The connecting intake pipe 12B and the downstream intake pipe 13B are coupled or connected to each other by a male-female fitting so as to align the four individual intermediate intake passages 15*a* with the four individual downstream intake passages 15, respectively. The enlarged end portion 11*a* of the upstream intake pipe 11 is joined or coupled to the connecting intake pipe 12B in flange-to-flange connection so as to integrate the individual intermediate intake passages 15*a* into the enlarged end portion 11*a* of the upstream intake pipe 11.

In a solid portion 17, remaining among the individual intermediate intake passages 15*a* of the connecting intake pipe 12B there is formed an axially extending bore 17*a* for receiving therein a multi nozzle fuel injector 19B having, in this embodiment, four injection nozzles 19*a*. The solid portion 17 is further formed with a gallery of four injection bores 17*b*, each of which is independent from the others and extends radially downward from the bottom of the injector receiving bore 17*a* so as to open into the individual intermediate intake passage 15*a*. The multi nozzle fuel injector 19B injects fuel into the individual downstream intake passages 15 through the independent injection bores 17*b*, respectively. An open end of the solid portion 17 is closed by a cap or plug 18.

Upper portions of the individual downstream intake pipes 13*a* are surrounded by an external pipe wall 13*b* so as to form a space or jacket 21 around each individual downstream intake pipe 13*a* and among the individual downstream intake pipes 13*a* for exhaust gas recirculation (EGR) from an exhaust system into the intake system. The jacket 21 allows exhaust gases to recirculate therethrough so as to heat each individual downstream intake pipe 13*a*, thereby enhancing the gasification and atomization of fuel in the individual downstream intake pipes 13*a*.

The intake system with the intake manifold described above distributes fuel from the multi nozzle injector 19B equally into the cylinders, which results in allowing the engine to operate efficiently and with high performance. The intake system is allowed to be more compact by the installation of the intake manifold 10B than by the installation of the intake manifold 10A of the previous embodiment.

Figure 7:
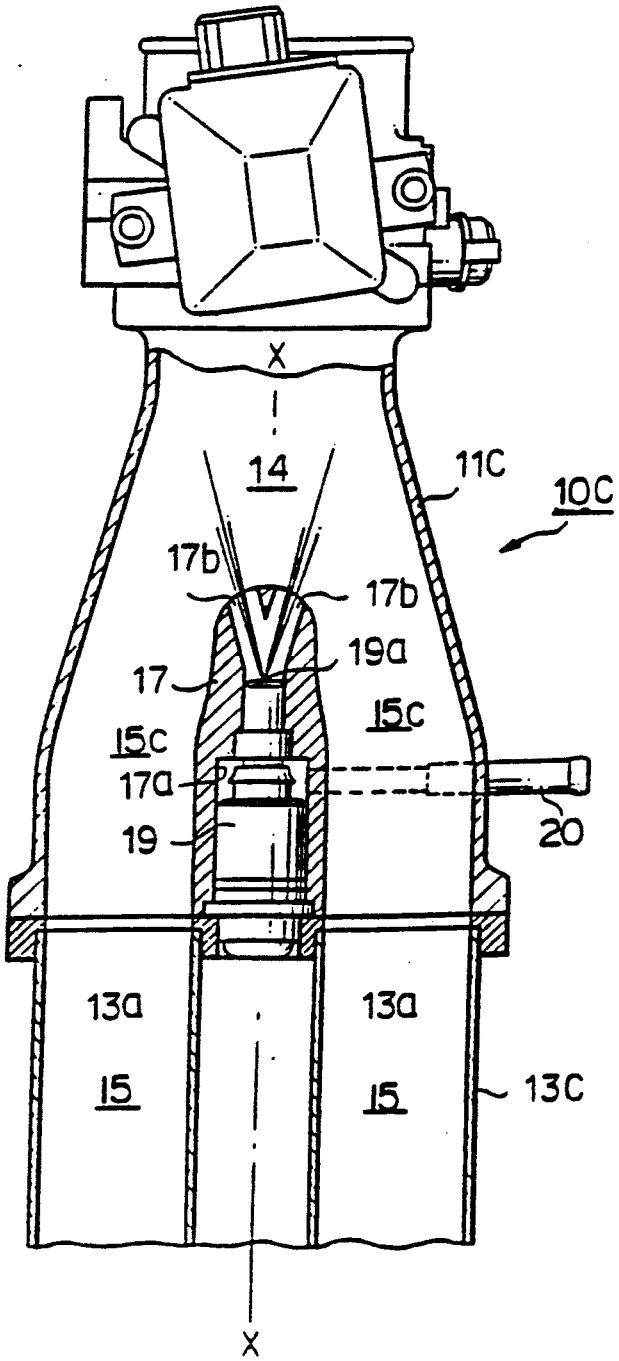
FIG. 7 is a vertical sectional view showing a part of an intake manifold of an intake system for a four-cylinder internal combustion engine in accordance with still another preferred embodiment of the present invention.

Referring to FIG. 7, an intake manifold 10C for use with a multi cylinder internal combustion engine in accordance with still another preferred embodiment of the present invention is shown. This intake manifold comprises, in order from the upstream end, an upstream intake pipe 11C and a downstream intake pipe 13C. The upstream intake pipe 11C is formed with four individual intake passages 15*c* at its downstream end portion which are arranged symmetrically with respect to an longitudinal axis X of the intake manifold 10C and merge into an upstream passage 14. The upstream intake pipe 11C, made as an integral part, has a generally cylindrical center partition wall 17 extending upward along the longitudinal axis X of the intake manifold 10C. The generally cylindrical center partition wall 17 has an axially extending bore 17*a* for receiving therein a multi nozzle fuel injector 19 having, in this embodiment, four injection nozzles 19*a*. The center partition wall 17 is further formed with a gallery of four injection bores 17*b*, each of which is independent from the others and extends upstream and radially upward from the top opening of the injector receiving bore 17*a* so as to open into the upstream passage 14.

The downstream intake pipe 13C is formed with four downstream intake passages 15 individually in communication with intake ports of the cylinders of the engine at their downstream ends. Upstream end portions of the passages 15 are defined by four individual downstream intake pipes 13*a*, joined together, and are arranged symmetrically with respect to a longitudinal axis X of the intake manifold 10C. The upstream and downstream intake pipes 11C and 13C are connected or coupled by a flange-to-flange connection.

The multi nozzle fuel injector 19B injects fuel into the upstream passage 14 through the independent injection bores 17*b*.

An intake system having the intake manifold 10C shown in FIG. 7, in which the fuel injector 19 injects fuel upward, enhances the gasification and atomization of fuel in the intake manifold more effectively than previously known intake systems.

FIGS. 8 through 11 show another type of intake manifold which is different from the previous embodiments shown in FIGS. 1 through 7 but can provide the same results as the previous embodiments.

The intake manifold 40 of this type of manifold basically comprises an upstream intake pipe 31, forming an upstream intake passage 34, and a downstream intake pipe 33, forming four downstream intake passages 35 which are connected or coupled so as to form an L-shaped intake passage. The upstream intake pipe 31, having a closed end 31*a*, is formed with a side opening 31*b* located close to the closed end 31*a*.

The downstream intake pipe 33 is formed with four downstream intake passages 35 individually in communication with intake ports of the cylinders of the engine at their downstream ends. The four individual downstream intake passages 35 are defined by four individual downstream intake pipes 33*a* joined or integrated together at their upstream end portions and arranged symmetrically with respect to a longitudinal axis Y of the downstream intake pipe 33. A space formed among the four individual downstream intake pipes 33*a* is closed by a cone-shaped cap 41. At least the upstream end portions of the individual downstream intake pipes 33*a* may be formed as an integral part.

The upstream and downstream intake pipes 31 and 33 are connected or coupled by a flange-to-flange connection so that longitudinal axes Y and Z of the pipes 31 and 33 intersect perpendicularly to each other to communicate all the individual downstream intake passages 35 with the opening 31*b* of the upstream intake pipe 31, thereby forming the L-shaped intake passage.

Figure 8:
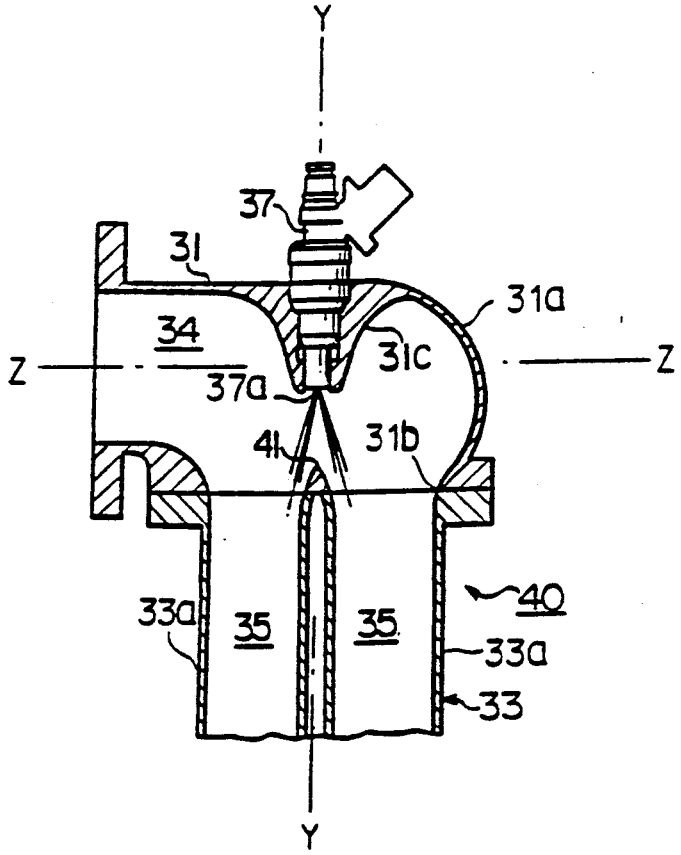
FIGS. 8 to 11 are vertical sectional views, each showing a part of a variant of an intake manifold of an intake system for a four-cylinder internal combustion engine according to the present invention.

Referring to FIG. 8, it may be seen that the upstream intake pipe 31 is further formed with a boss 31*c* projecting towards a center of the side opening 31*b* within the upstream intake passage 34. A fuel injector 37, having a single injection nozzle 37*a*, is embedded in the projection 31*c* so as to locate the injection nozzle 37*a* close to the tip of the cone-shaped cap 41 and perpendicularly relative to the longitudinal axis Z of the upstream intake passage 34. The fuel injector 37 may otherwise have four injection nozzles which inject fuel into the four individual downstream intake passages 35, respectively.

Locating the fuel injector 37, in particular the injection nozzle or nozzles 37*a*, close to the tip of the cone-shaped cap 41 makes it possible to construct the intake system compactly and to deliver fuel almost equally into the four individual downstream intake passages 35.

Figure 9:
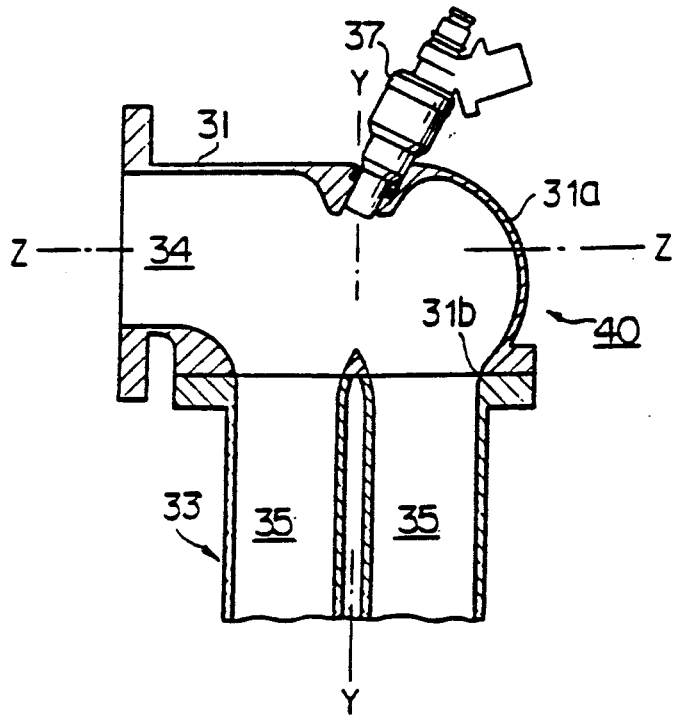

In order to cause the intake manifold 40 shown in FIG. 8 to improve the uniformity of fuel distribution, the fuel injector 37 may be inclined. As is shown in FIG. 9, the fuel injector 37, embedded in the boss 31*c*, is inclined to direct the injection nozzle 37*a* towards the upstream side of the upstream intake passage 34 remote from the closed end 31*a* of the upstream intake pipe 31.

Figure 10:
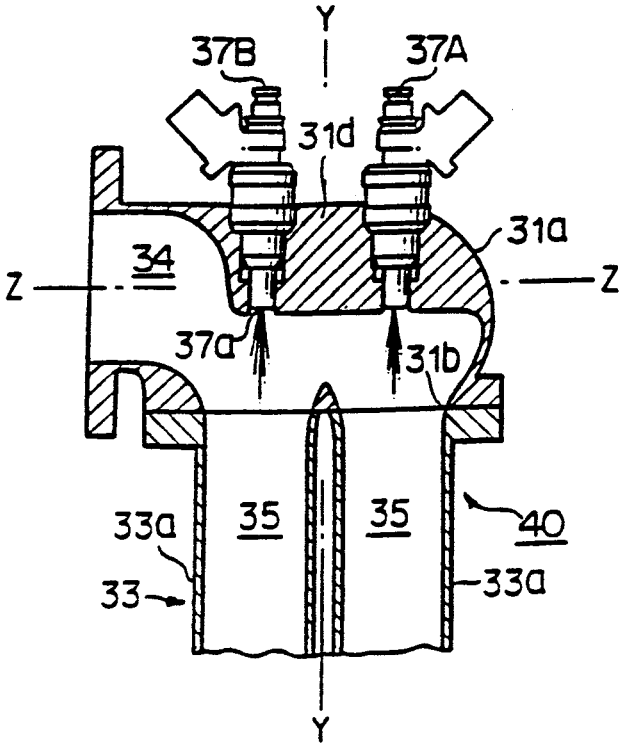

Referring to FIG. 10, the upstream intake pipe 31 is formed with an inner bank 31*d* above the side opening 31*b* within the upstream intake passage 34. Two fuel injectors 37 are embedded in the inner bank 31*d* so as to orient the injection nozzles 37*a* so that they are located close to the upstream ends of the downstream intake passages 35 and perpendicular to the longitudinal axis Z of the upstream intake passage 34.

The intake manifold 40 of this embodiment decreases fuel adhesion on the surface of the downstream individual intake pipes 33*a* and improves the uniformity of fuel distribution into the individual downstream intake passages 35.

Figure 11:
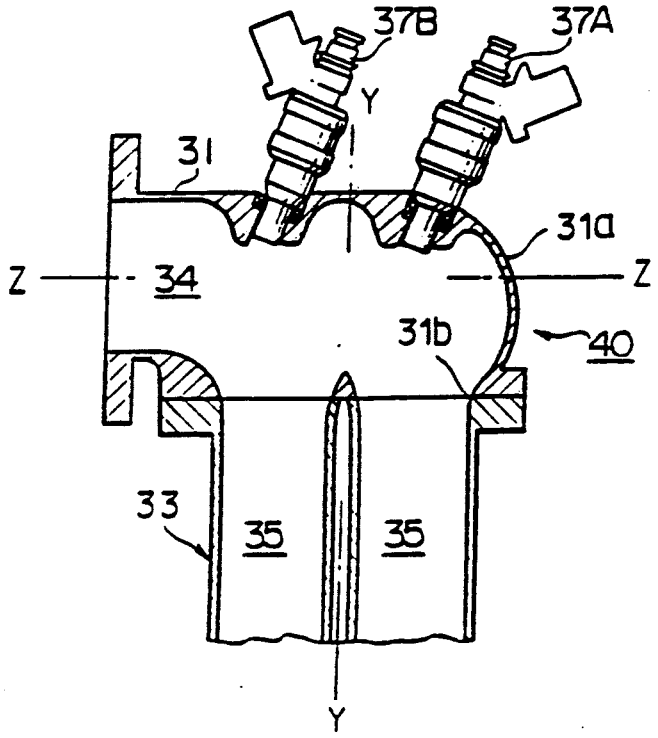

The intake manifold 40 shown in FIG. 10 improves uniformity of fuel distribution by inclining the fuel injectors 37. That is, as is shown in FIG. 11, each fuel injector 37, embedded in the bank 31*d*, is inclined to direct the injection nozzle 37*a* towards the upstream side of the upstream intake passage 34 remote from the closed end 31*a* of the upstream intake pipe 31.

It is to be understood that although the present invention has been fully described with respect to preferred embodiments thereof, various other embodiments and variants are possible which fall within the scope and spirit of the present invention, and such other embodiments and variants are intended to be covered by the following claims.

What is claimed is:

1. An intake manifold of an intake system for supplying a fuel mixture into a multi cylinder internal combustion engine comprising:

upstream intake passage means for forming a common upstream passage portion of said intake manifold common to all cylinders of said multi cylinder internal combustion engine;

downstream intake passage means, connected between a downstream end of said upstream intake passage means and said cylinders, for forming individual downstream passage portions of said intake manifold leading individually to the cylinders, upstream end portions of said individual downstream passage portions being symmetrically joined together with respect to a centerline of said common upstream passage portion, centerlines of said individual downstream passage portions being arranged at substantially equal spacings from each other;

fuel injection means for introducing fuel into said intake system disposed at a center of said symmetrically joined upstream end portions of the individual downstream passage portions, said upstream end portions of said individual downstream passage portions being symmetrically arranged with respect to said fuel injection means; and fuel passage means, opening into an upstream end portion of each individual downstream passage portion, for introducing fuel from said fuel injection means into said individual downstream passage portions.

2. An intake manifold as recited in claim 1, wherein said fuel injection means comprises a single outlet fuel injector.

3. An intake manifold as recited in claim 1, wherein said fuel injection means comprises a multi outlet fuel injector.

4. An intake manifold as recited in claim 1, wherein said fuel passage means comprises a gallery extending downward from said fuel injection means to each individual downstream passage portion.

5. An intake manifold as recited in claim 1, wherein said common upstream passage portion comprises a downstream end portion which gradually expands in cross section towards a downstream end thereof.

6. An intake manifold as recited in claim 1, wherein said common upstream passage portion comprises a downstream end portion which gradually expands in cross section towards a downstream end thereof and branches off therefrom into said individual downstream passage portions.

7. An intake manifold of an intake system for supplying a fuel mixture into a multi cylinder internal combustion engine comprising:

upstream intake passage means for forming a common upstream passage portion of said intake manifold common to all cylinders of said multi cylinder internal combustion engine;

downstream intake passage means, connected between a downstream end of said upstream intake passage means and said cylinders, for forming individual downstream passage portions of said intake manifold leading individually to the cylinders, upstream end portions of said individual downstream passage portions being symmetrically joined together with respect to a centerline of said common upstream passage portion;

fuel injection means for introducing fuel into said intake system disposed at a center of said symmetrically joined upstream end portions of the individual downstream passage portions, said upstream end portions of said individual downstream passage portions being symmetrically arranged with respect to said fuel injection means; and fuel passage means, opening into an upstream end portion of each individual downstream passage portion, for introducing fuel from said fuel injection means into said individual downstream passage portions, said fuel passage means comprising a gallery of injection bores extending from said fuel injection means to individual downstream passage portion.

8. An intake manifold of an intake system for supplying a fuel mixture into a multi cylinder internal combustion engine comprising:

upstream intake pipe means for forming a common upstream passage portion of said intake manifold common to all cylinders of said multi cylinder internal combustion engine;

fuel injection means for introducing fuel into said intake system; and downstream intake pipe means for forming individual downstream passage portions of said intake manifold arranged symmetrically with respect to a centerline of said downstream intake pipe means and extending between a downstream end of said upstream intake pipe means and said cylinders, respectively, said downstream intake pipe means being formed with a bore extending in a lengthwise direction thereof among said individual downstream passage portions for receiving said fuel injection means therein and gallery means, extending from said bore to said individual downstream passage portions, for introducing fuel from said fuel injection means into said individual downstream passage portions.

9. An intake manifold as recited in claim 8, wherein said gallery means comprises a bore extending downward and opening to each individual downstream passage portion.

10. An intake manifold as recited in claim 8, wherein said gallery means comprises a bore opening to each individual downstream passage portion.

11. An intake manifold as recited in claim 8, wherein said downstream intake pipe means comprises an upstream end part wherein said bore is formed and a downstream end part which is connected to said upstream end part and in which a water jacket is formed below said bore.

12. An intake manifold as recited in claim 11, wherein said downstream intake pipe means further comprises a water jacket surrounding said downstream end part.

* * * * *